US005688106A

United States Patent [19]

Cerruti et al.

[11] Patent Number: 5,688,106

[45] Date of Patent: Nov. 18, 1997

[54] TURBOMOLECULAR PUMP

[75] Inventors: Roberto Cerruti; Giampaolo Levi, both of Torino, Italy

[73] Assignee: Varian Associates, Inc., Palo Alto, Calif.

[21] Appl. No.: 748,526

[22] Filed: Nov. 8, 1996

[30] Foreign Application Priority Data

Nov. 10, 1995 [IT] Italy ..... T95A00911

[51] Int. Cl.[6] ..... F01D 1/36; F04D 19/04

[52] U.S. Cl. ..... 415/90; 415/143

[58] Field of Search ..... 415/90, 143, 170.1, 415/171.1, 173.7, 174.5; 417/423.4

[56] References Cited

U.S. PATENT DOCUMENTS 4,655,678 4/1987 Miki ..... 415/90

5,238,362 8/1993 Casaro et al. .

5,358,373 10/1994 Hablanian .

5,547,338 8/1996 Conrad et al. ..... 415/90

FOREIGN PATENT DOCUMENTS 0255596 10/1988 Japan ..... 415/90

*Primary Examiner*—Christopher Verdier

*Attorney, Agent, or Firm*—Bella Fishman

[57] ABSTRACT

A turbomolecular pump comprises a pump body housing a gas inlet and a gas exhaust port and a plurality of pumping assemblies with interleaved rotors and stators located within the pump body. The rotors are secured to a rotating shaft that is supported by at least one rotatable support and driven by a motor. At least one stator of the pumping assemblies is provided with at least one spiral channel adapted to push and eject the gases from an area proximal to the shaft toward an area distal from the shaft and vice versa.

16 Claims, 5 Drawing Sheets

TURBOMOLECULAR PUMP

FIELD OF THE INVENTION

The present invention relates to turbomolecular pumps. More particularly, the invention refers to a turbomolecular vacuum pump provided with pumping stages with a high compression ratio, of the type used in the manufacturing of semiconductor devices.

BACKGROUND OF THE INVENTION

Turbomolecular vacuum pumps have been widely used in the manufacturing of semiconductor devices since the introduction of dry etching methods in the manufacturing of integrated circuits (IC) or chips.

One of the main problems when using turbomolecular pumps in the semiconductor industry is the low resistance to corrosion of the conventional ball bearings and magnetic media when exposed to corrosive gas mixtures, such as HCl, HBr, $CL_2$, $Fl_2$, etc., normally used in the processing of integrated circuits. This is due to the build up of not negligible mounts of gas because of diffusion phenomena through the pumping stages of the pump. These gases can irremediably alter both the steel of the end supporting members and the material of the cages in the bearings, and the lubricant contained therein, thus causing a failure of the bearings.

In order to avoid a quick damaging of the turbomolecular pumps, it has been necessary to develop special pumps resistant to corrosion, known as "CP" (Corrosion Proof) pumps.

With this type of pump an inert gas flow is admitted into the space housing the bearings and forms a barrier against the entry of corrosive substances produced in the processes for IC manufacturing.

FIG. 1 is a schematic view showing a longitudinal cross section of a conventional turbo-molecular pump 1' equipped with a first assembly **56*a*' of pumping stages having stators 5*a*' and rotor disks with blades 6*a*', and a second assembly 56*b*' of pumping stages having stators 5*b*' smooth rotor disks 6*b*'**.

A pump of this type has been disclosed in the U.S. Pat. No. 5,238,362, "Turbomolecular Pump" assigned to the Applicant of the present invention and incorporated herein by reference. This pump has been modified to allow the admission of an inert gas for use in the above mentioned application.

Referring to FIG. 1, the arrows schematically show the path of an inert gas, admitted under pressure through a radial hole 16' into the gaps between the motor assembly 10' and the pump body 2', and directed towards the bearing 8'. In a pump of this type, for conveying the flow of inert gas towards the bearing 8' a circular plate 11', separating the bearing 8' from the second pumping assembly **56*b*' of pumping stages having smooth rotor disks 6*b*', is provided with three radial channels 14' angularly spaced at 120° from each other and communicating with as many axial holes 17', provided in the body 2' of the pump 1' and the motor assembly 10'. Thus said channels 14' communicate with the openings or ports existing between the body 2' of the pump 1' and the motor assembly 10'**.

In spite of a relevant decrease of the corrosive gases, this solution still has a number of drawbacks. First, it requires a source of dry nitrogen, a connecting circuit for admitting the gas—provided with valves and adjusting means, and a main pump having a larger flow rate for pumping the inert gas.

Additionally, the admission of an extraneous gas into the manufacturing process could contaminate or alter the initial mixture of gases used in the manufacturing cycle, while at the same time reducing the pump final pressure.

To solve the above mentioned problems, L. Mathieu and J. M. Gruffat of ALCATEL CIT, have proposed a solution known as "Inverted Dynamic Seal". A detailed description of such solution was published in "Vacuum", Volume 44, numbers 5–7, at page 701 to 703, Pergamon Press Ltd, 1993. FIG. 2 shows a schematic turbomolecular pump with inverted dynamic seal.

Referring to FIG. 2, the inverted dynamic seal substantially comprises screw 101 located inside cylindrical chamber 102 having a smooth wall and formed in body 103 of the rotor assembly 100 of the pump. The rotating motion, and the reduced gap between the walls of chamber 102 and screw 101 generate a pressure difference that can be used to achieve the so-called "inverted dynamic seal" as well as for pumping the gas. The obtained sealing is implemented in a turbomolecular pump 100, and is used for pumping the gas into the space housing bearings 105.

The turbomolecular pump with inverted dynamic seal presents a number of drawbacks. Firstly, the inverted dynamic seal is poorly effective when the gases to be pumped are lighter than Ar (40), e.g. HF (20), HCl (36), and for low flow rate of the gases to be pumped.

Additionally the inverted dynamic seal is not suitable for applications wherein the input pressures are higher than $10^{-2}$ Pa, that is for high pumping flow rates, when on the contrary a maximum protection against corrosive gases would be required. Moreover, it is difficult to manufacture the screw of the inverted dynamic seal which is located within the chamber housing the bearings.

There are also known turbomolecular pumps provided with spiral-shaped pumping stages of the so-called Siegbahn type. Such pumps have only been realized in a single-stage configuration with the gas pumping occurring exclusively within the spirally-shaped channel, and no gas pumping would be possible without this channel.

SUMMARY OF THE INVENTION

The main object of the present invention is to provide a turbomolecular pump equipped with a dynamic seal that achieves the advantages of the known solutions, while at the same time avoiding the drawbacks thereof.

Another object of the present invention is to provide a turbomolecular pump having pumping stages with a high compression ratio.

A further object of the present invention is to provide a dynamic seal that is easy and economical to be manufactured.

In accordance with the present invention there is provided a turbomolecular pump with a pump body having a gas inlet port and gas exhaust port; and a plurality of vacuum pumping stages located therewith and disposed between the inlet port and exhaust port. Each pumping stage comprises a rotor and a stator with a pair of faces wherein at least one stator has at least one spiral channel formed on one of the faces of the stator. The turbomolecular pump also comprises a rotating shaft for securing each rotor thereto, which is held by at least one support means. A plate is positioned between the support means and the pumping stage proximate thereto. The plate has at least one spiral channel formed on a surface facing said proximate pumping stage for pushing and ejecting gases contained in the channel from an area proximal to the shaft to an area distal therefrom. The pump body further comprises at least one axial hole in proximity to said plate, and said plate further comprises at least one radial channel which is in communication with said axial hole for admitting inert gases in a space between the plate and the rotor of the proximate pumping stage and forming a spiral seal with the spiral channel.

According to one embodiment of the present invention, the plate has four spiral channels extending in identical directions. According to another embodiment of the present invention, one or more pumping stages of the turbomolecular pump are located in proximity to the inlet port comprising rotors with blades and form a first pumping assembly, while one or more pumping stages are located in proximity to the exhaust port comprising rotors with flat disks and form a second pumping assembly, wherein at least one stator of the second pumping assembly comprises at least one spiral channel on each or at least one face thereof.

The foregoing and other object features and advantages of the present invention will become apparent from the following detailed description of the preferred embodiments, taken together with the accompanying drawings.

DESCRIPTION OF THE PREFERRED EMBODIMENTS

Figure 3:
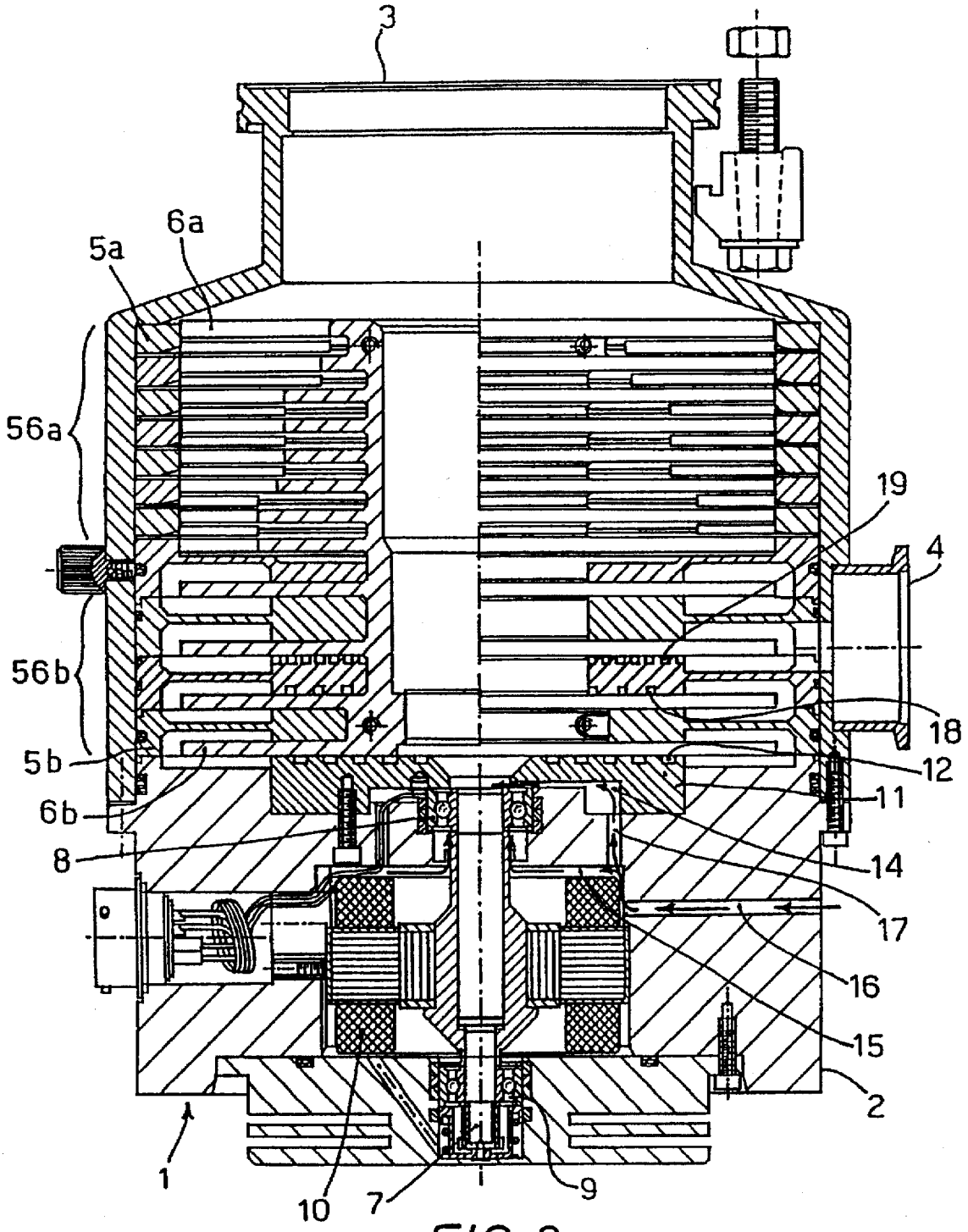
FIG. 3 is a cross section view of a turbomolecular Pump according to the present invention.

With reference to FIG. 3, the turbomolecular pump 1 of the present invention comprises a substantially cylindrical pump body 2 provided with axial inlet port 3 and radial exhaust port 4 for the gases.

Within pump body 2, in the portion of the pump facing inlet port 3, there is fitted first pumping assembly **56*a*, formed by a plurality of stators 5*a* and rotors 6*a*, these latter being provided with blades, with the stators and rotors being coplanar (i.e. substantially laying in a same plane) and alternating with each other. Each pair of respective stator and rotor of the plurality of stators 5*a* and rotors 6*a*** forms a pumping stage.

A second pumping assembly **56*b*, formed by a plurality of stators 5*b* and rotors 6*b* that are smooth (i.e. without blades), coplanar and alternating with each other are fitted within pump body 2, near exhaust port 4, and axially aligned with said first pumping assembly 56*a*. Each pair of respective stator and rotor of the plurality of stators 5*b* and rotors 6*b*** forms a pumping stage.

Rotors **6*a* and 6*b* are secured to rotating shaft 7, which is supported by a pair of bearings 8 and 9 with motor assembly 10 located therebetween. Circular plate 11 is provided between bearing 8 and second pumping assembly 56*b*, and spiral channel 12 is formed in the plate surface facing first rotor 6*b* of pumping assembly 56*b***.

Figure 4:
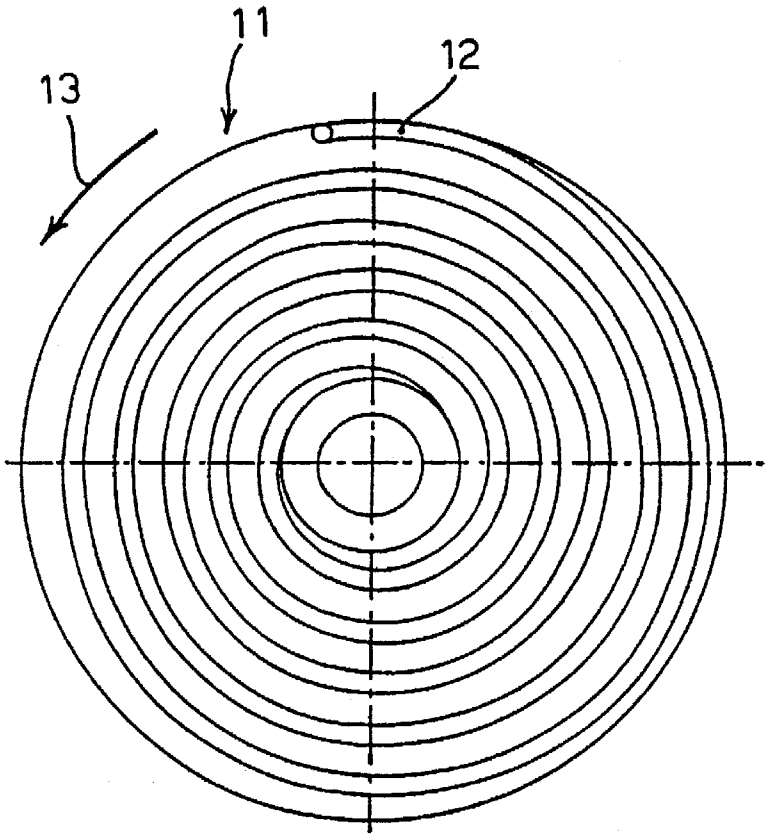
FIG. 4 is a plan view of the plate in which a spiral seal with a single channel is formed.

As better seen in FIG. 4, spiral channel 12 is designed so that when rotors **6*a* and 6*b* rotate in the direction of arrow 13, the gases contained in the channel are pushed and ejected from the area proximal to shaft 7 towards an area distal therefrom. This way spiral channel 12** forms an effective pumping stage with its own characteristic compression ratio and pumping speed.

Figure 6:
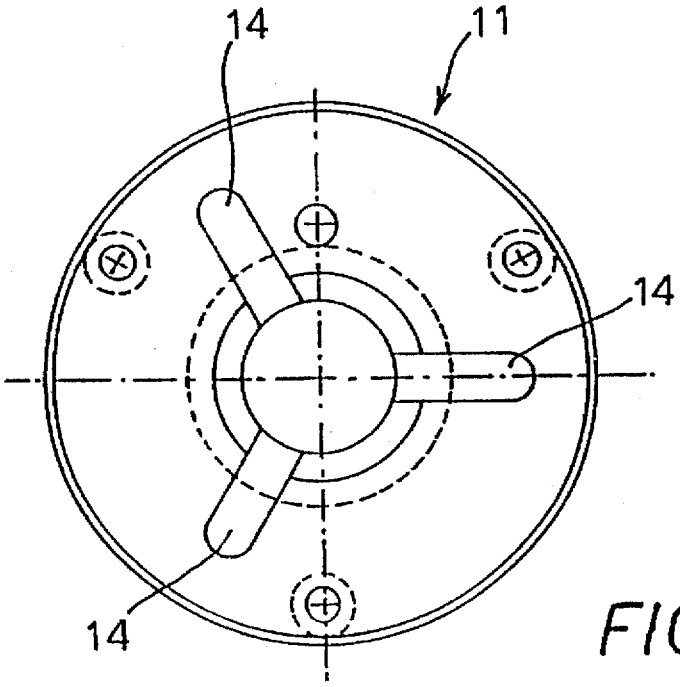
FIG. 6 is a plan view of the plate, as seen from the opposite side of that of FIGS. 4 or 5.

As shown in FIG. 6, circular plate 11 is also provided with three radial channels 14, located at 120° with respect of each other, and each radial channel communicating with one of three axial holes 17 in pump body 2 that open into space 15 housing motor 10. A radial hole 16 passes through the pump body 2 and allows the admission of an inert gas into space 15.

As schematically illustrated by arrows in FIG. 3, the inert gas flows from space 15 through axial holes 17 and radial channels 14 into the gap between plate 11 and adjacent rotor **6*b* on which a spiral seal is formed by spiral channel 12. Due to the pumping action produced by spiral channel 12 and the action of the inert gas present in correspondence of plate 11 within spiral channel 12, the corrosive gases are pushed away from bearing 8 and ejected towards gas exhaust port 4 of pump 1**.

From tests that have been carded out it has been verified that the amount of inert gas, e.g. $N_2$ used for protecting the bearings in pumps equipped with a spiral channel as above described is lower than the amount required in pumps without such spiral sealing.

Figure 5:
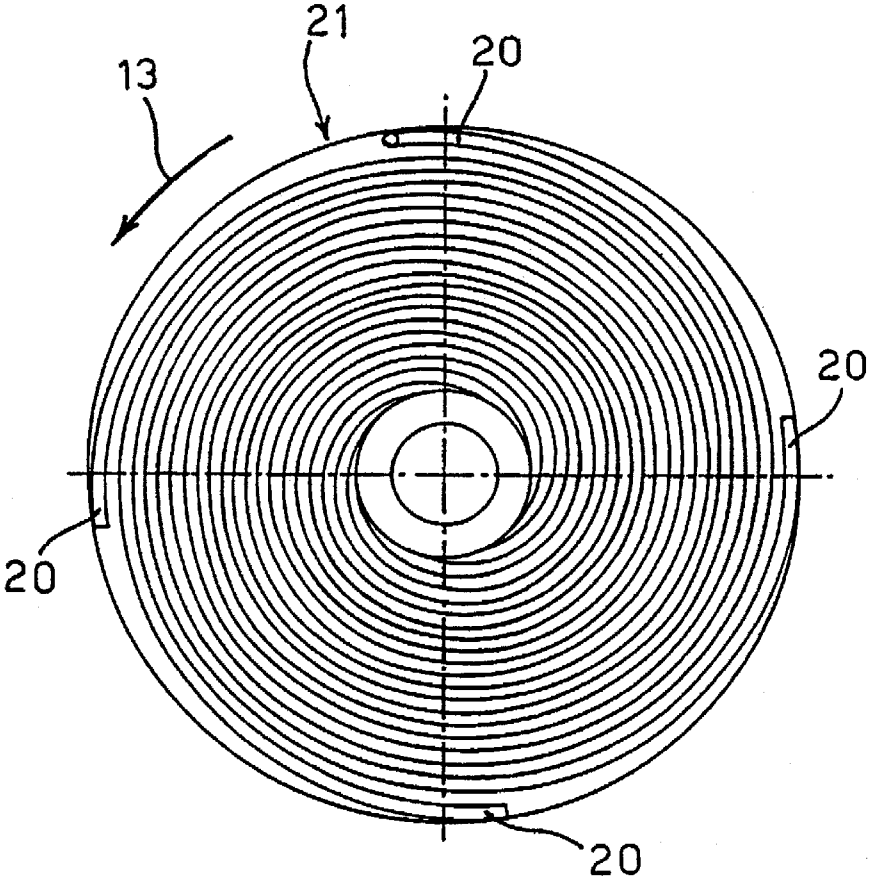
FIG. 5 is a plan view of the plate in which a spiral seal with four channels is formed.

FIG. 5 illustrates another embodiment of the spiral sealing of the present invention in which the spiral sealing formed on the surface of the plate 21 comprises four spiral channels 20 extending in the same direction. In the embodiment of FIG. 5 there has been experimentally achieved a 30% reduction of the amount of inert gas required for maintaining the bearings of the turbo-molecular pump free from corrosive gases.

The spiral sealing according to the present invention can be advantageously used even between two pumping stages of the type with flat rotor disk **6*b* to achieve an increased compression ratio of the pumping stages in which the rotors 6*b* are located. According to the present invention stator 5*b* of second pumping assembly 56*b*, which is proximal to plate 11, may be provided with at least one spiral channel formed on a surface facing plate 11 for pumping gases inwardly towards shaft 7, while a plurality of channels are formed on the opposite surface of stator 5*b* for pumping gases outwardly from shaft 7**.

Referring again to FIGS. 3 and 7 to 9, one of the stators **5*b* is provided with a double spiral sealing each cooperating with the corresponding adjacent rotor 6*b*. The double spiral sealing is obtained by means of single spiral channel 18 located on a face of stator 5*b*, and by means of four spiral channels 19, located on the opposite face of adjacent stator 5*b***.

Channels 18 and 19 are oriented in such a manner as to generate a counter-pumping effect with respect to the pumping flow generated by the pumping stage, such counter-pumping contrasting the natural movement of the escaping gas molecules towards the stages with higher pressure, through the ports located between the plane of rotor disks **6*b* and the plane of stator disks 5*b***.

Figure 9:
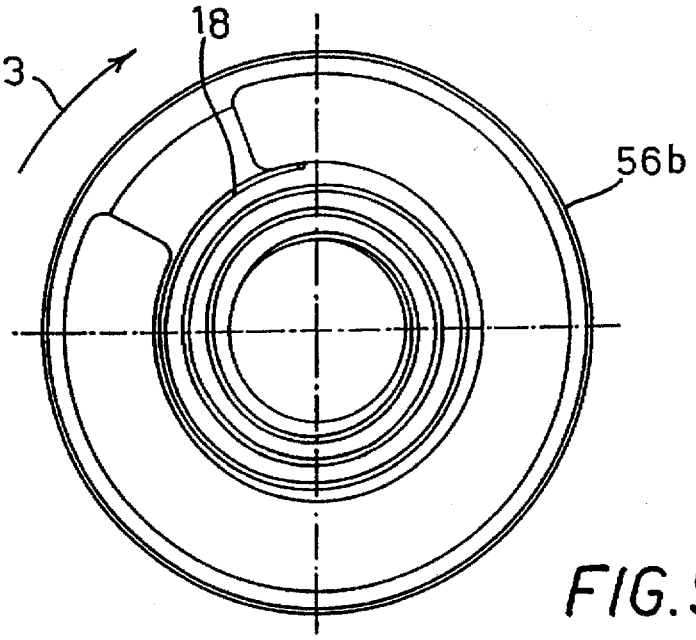
FIG. 9 is a plan view from the opposite side in respect to that shown in FIG. 8 of the stator of FIG. 7.
Figure 7:
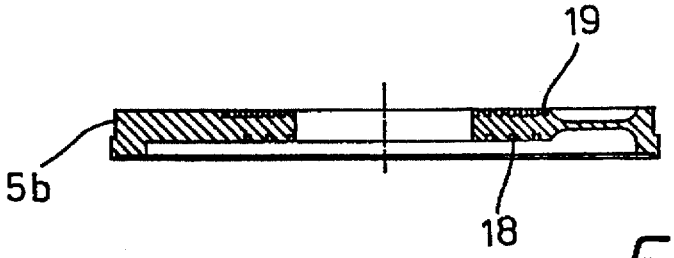
FIG. 7 is a cross section view of one of the stators of the pump shown in FIG. 3.
Figure 8:
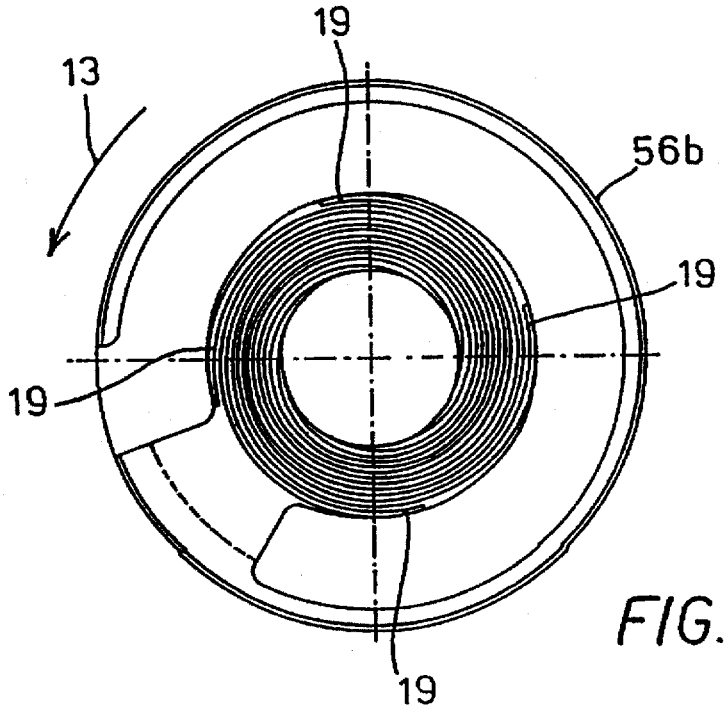
FIG. 8 is a plan view of the stator shown in FIG. 7.

FIGS. 8 and 9 illustrate the spiral orientation with respect to motion of the rotor disk, with the rotating direction indicated by arrow 13. In this way, an outwardly directed pumping of the gases is achieved, thus increasing the sealing of the pumping stages and their compression ratio.

The choice between the configuration with a single channel 18 and that with four channels 19 is based upon the fact that the sealing results of the single spiral channel are better at low pressures, typically about $10^{-1}$ Pa, while the four channels sealing presents better results at high pressures, typically about 10 Pa, that should be present in proximity of the gas exhaust port of the pump.

Though in this configuration the spiral sealing looks similar to the one known as labyrinth sealing, their functions in the turbomolecular pump differ dramatically. The object of a labyrinth sealing is to geometrically increase the length of the interstitial paths between the static and rotating parts of the turbomachines to reduce the conductances, and therefore the losses due to blow-by. Thus the labyrinth sealings are "static" devices since they do not use the rotation of moving parts for achieving the sealing effect, but only use the geometrical effect of a path increase.

On the contrary, the spiral sealing of the present invention, besides contributing to geometrically increase the length of the escaping ways, dynamically operates by pumping away the gas which tends to enter the ducts.

Yet another embodiment of the present invention provides for reversing the orientation of the single spiral channel, or the four spiral channels, in respect to what was previously described and shown in the embodiments. In case the spiral channel or channels are incoming in respect of the rotation of the rotor disc, and the channel inlets are located in correspondence of the outlets of the pumping channels in the pumping assembly, there is achieved a pumping effect with the same direction of the pumping stage with smooth rotors. With this solution in which the gas is pushed into the spiral channel end ejected toward the pump interior, one obtains an increased compression ratio of the pumping stage due to the pumping effect of the spiral channel or channels.

A preferred embodiment, particularly suitable in presence of corrosive gases, provides for arranging three spiral seals in series, positioned as illustrated in FIG. 3, with the first one having a single channel and pumping outwardly, formed on the surface of plate 11 facing rotor **6*b*; the second one, having a single channel and pumping inwardly, formed on the surface of stator 5*b* facing the plate 11; and the third one, having four channels and pumping outwardly, formed on the other face of same stator 5*b***. In a pump according to this configuration, it has been experimentally found that the pumping stage incorporating such spiral channel has a compression ratio k=10. By using three spiral seals in series it was possible to achieve a compression ratio close to k=1000.

Figure 1:
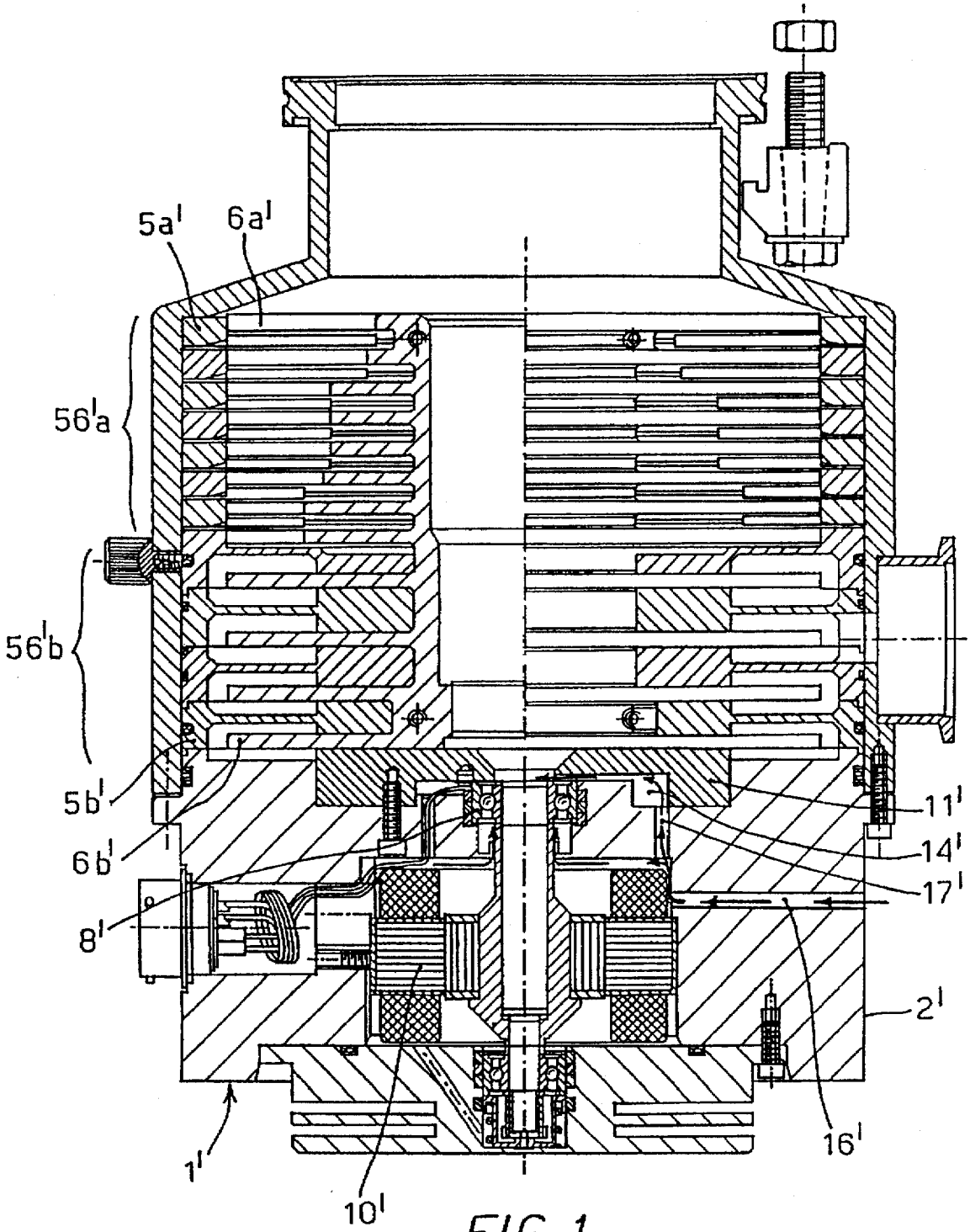
FIG. 1 PRIOR ART
FIG. 1 is a schematic cross section view of a turbomolecular pump of the prior art.
Figure 2:
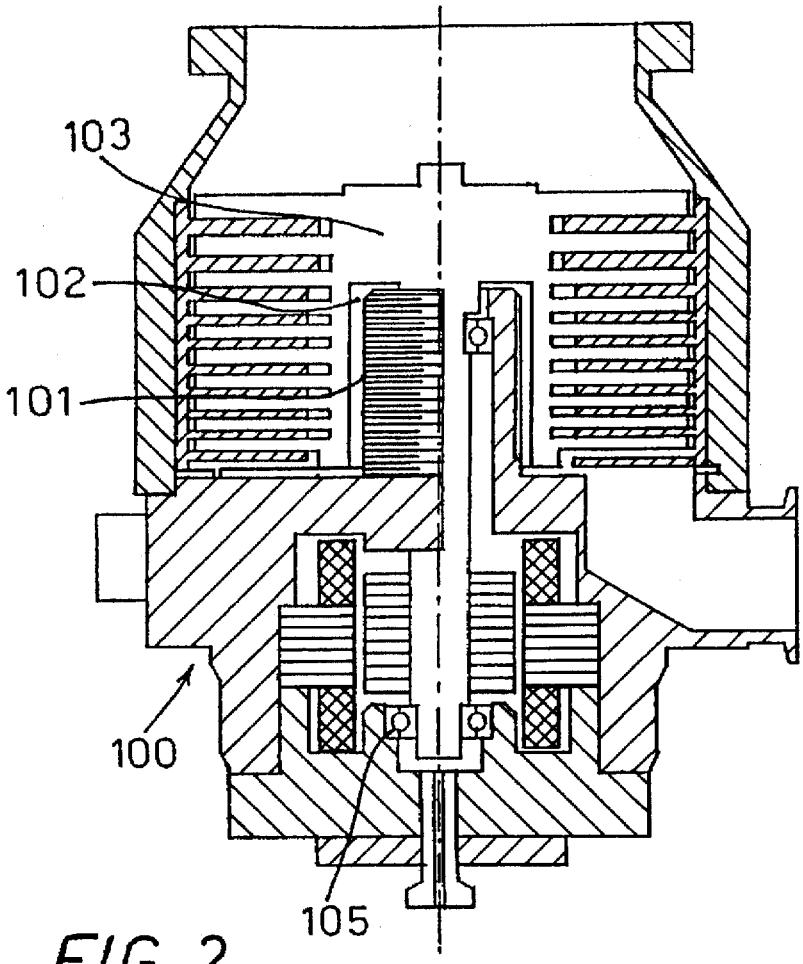
FIG. 2 PRIOR ART
FIG. 2 is a schematic cross section view of a turbomolecular pump incorporating an inverted dynamic seal of the prior art.

In respect to the inverted dynamic seal illustrated in FIG. 2, the sealing obtained through the present invention, when the pump sizes are equal, advantageously operates at higher peripheral speeds, typically 200 m/see instead of 70 m/see, being formed on a plane rather than on a cylinder located within the rotors. While the invention has been described with reference to specific embodiments, the description is illustrative of the invention and is not to be construed as limiting the various modifications and applications which may occur to those skilled in the art without departing from the true spirit of the invention as defined by the appended claims.

What is claimed is:

1. A turbomolecular pump comprising:

a pump body having a gas inlet port and a gas exhaust port;

a plurality of vacuum pumping stages within said body disposed between said inlet port and exhaust port, each said pumping stage comprising a rotor and a stator, said stator having a pair of opposite faces;

at least one stator of said plurality of vacuum pumping stages having at least one spiral channel formed on one of said faces of said at least one stator;

a rotating shaft for securing each rotor of said plurality of vacuum pumping states thereto;

at least one support means for holding said rotating shaft; and a plate which is positioned between said at least one support means for holding said rotating shaft and said pumping stage proximate thereto, said plate has at least one spiral channel formed on a surface facing said proximate pumping stage for pushing and ejecting gases contained in said at least one channel from an area proximal to said shaft to an area distal therefrom.

2. The turbomolecular pump of claim 1, wherein said pump body further comprising at least one axial hole in proximity to said plate, and said plate further comprising at least one radial channel which is in communication with said at least one axial hole for admitting inert gases in a space between said plate and said rotor of said proximate pumping stage and forming a spiral seal with said at least one spiral channel.

3. The turbomolecular pump of claim 2, wherein said plate has three radial channels which are in communication with respective axial holes of said pump body.

4. The turbomolecular pump of claim 3, wherein said radial channels are equally distant therebetween.

5. The turbomolecular pump of claim 2, wherein said plate has four spiral channels extending in identical directions.

6. The turbomolecular pump of claim 2, wherein at least one pumping stage of said plurality of vacuum pumping stages located in proximity to said inlet port forms with an adjacent pumping stage a first pumping assembly, wherein rotors of said first pumping assembly comprise blades; and at least one pumping stage of said plurality of vacuum pumping stages located in proximity to said exhaust port forms with a neighboring pumping stage a second pumping assembly, wherein rotors of said second pumping assembly comprise flat disks.

7. The turbomolecular pump of claim 6, wherein at least one stator of said second pumping assembly comprises at least one spiral channel on each face of said at least one stator of said second pumping assembly.

8. The turbomolecular pump of claim 6, wherein said stator of said second pumping assembly comprises a plurality of spiral channels on at least one face of said stator of said second pumping assembly.

9. The turbomolecular pump of claim 6, wherein said stator of said second pumping assembly comprises one spiral channel on a surface of said stator facing said plate, and four spiral channels on an opposite surface of said stator of said second pumping assembly.

10. A turbomolecular pump comprising:

a pump body having an inlet port and an exhaust port;

first and second pumping assemblies disposed within said pump body in proximity to said inlet and exhaust ports respectively;

each said pumping assembly has a plurality of rotors and stators, each rotor of said pumping assemblies being adjacent to a respective stator, each rotor of said first pumping assembly comprising a rotor disk with blades, and each rotor of said second pumping assembly comprising a flat rotor disk;

a rotating shaft for securing a plurality of rotors of said first and second pumping assemblies thereon;

a supporting means for holding said rotating shaft;

a plate positioned between said rotating shaft and supporting means, said plate having at least one spiral channel on a surface facing said rotor of said second pumping assembly proximal thereto for pumping gases outwardly from an area proximal to said rotating shaft; and said stator of said second pumping assembly proximal to said plate comprising at least one spiral channel formed on a first surface facing said plate for pumping gases inwardly to an area proximal to said rotating shaft, and a plurality of channels formed on a second surface opposite to said first surface for pumping gases outwardly from an area proximal to said rotating shaft.

11. A turbomolecular pump comprising:

a pump body having gas inlet and gas exhaust ports;

pumping assemblies located within said pump body and formed by a respective plurality of stators and rotors, each said stator being adjacent to a respective rotor and comprising a pair of opposed faces, said pumping assemblies comprising a first pumping assembly in proximity to said gas inlet port and a second pumping assembly in proximity to said gas exhaust port, rotors of said first pumping assembly comprising rotor disks with blades and rotors of said second pumping assembly comprising flat rotor disks;

a rotating shaft, said plurality of rotors being secured to said rotating shaft;

at least one support for said rotation shaft;

a plate positioned between said second pumping assembly and said at least one support; and at least one of said stators being positioned in proximity to said plate comprising at least one spiral channel facing said plate, wherein said plate comprises at least one spiral channel.

12. The turbomolecular pump of claim 11, further comprising a pumping channel which is formed between said rotor of said second pumping assembly adjacent to said plate and said plate with said at least one spiral channel, wherein in operation gases contained in said at least one spiral channel are pushed and ejected from an area proximal to said shaft towards an area distal from said shaft.

13. The turbomolecular pump of claim 12, further comprising at least one radial inlet hole in said pump body for admitting an inert gas into said body.

14. The turbomolecular pump of claim 13, wherein said plate further comprises a plurality of radial channels and said pump body further comprises a respective plurality of axial holes for directing the gas flowing from said at least one radial inlet holes toward said at least one spiral channel.

15. The turbomolecular pump of claim 14, further comprising a spiral sealing provided on said plate and formed by said at least one spiral channel.

16. The turbomolecular pump of claim 14, wherein at least one stator is provided with at least one spiral channel on one face thereof, and at least another spiral channel is located on the opposite face thereto, said spiral channels defining pumping channels adapted to push and eject the gases in a direction from or towards an area proximal to said rotation shaft.

* * * * *